US008448369B2

(12) United States Patent
Hinds, Jr.

(10) Patent No.: US 8,448,369 B2
(45) Date of Patent: May 28, 2013

(54) BIPOD DEVICE FOR USE WITH PICATINNY RAIL

(76) Inventor: Richard A Hinds, Jr., West Columbia, SC (US)

( * ) Notice: Subject to any disclaimer, the term of this patent is extended or adjusted under 35 U.S.C. 154(b) by 129 days.

(21) Appl. No.: 13/143,449

(22) PCT Filed: Jan. 6, 2010

(86) PCT No.: PCT/US2010/020194

§ 371 (c)(1),
(2), (4) Date: Jul. 6, 2011

(87) PCT Pub. No.: WO2010/080785

PCT Pub. Date: Jul. 15, 2010

(65) Prior Publication Data

US 2011/0265366 A1 Nov. 3, 2011

Related U.S. Application Data

(60) Provisional application No. 61/143,026, filed on Jan. 7, 2009.

(51) Int. Cl.
*F41C 27/00* (2006.01)

(52) U.S. Cl.
USPC ..... 42/94

(58) Field of Classification Search
USPC ..... 42/94
See application file for complete search history.

(56) References Cited

U.S. PATENT DOCUMENTS

| | | | | |
|---|---|---|---|---|
| 4,625,620 | A * | 12/1986 | Harris | 89/37.04 |
| 4,776,124 | A | 10/1988 | Clifton | |
| 6,289,622 | B1 | 9/2001 | Desch, Jr. et al. | |
| 7,111,424 | B1 | 9/2006 | Moody et al. | |
| 7,631,455 | B2 * | 12/2009 | Keng et al. | 42/94 |
| 8,341,866 | B1 * | 1/2013 | Gaddini et al. | 42/72 |
| 2005/0188597 | A1 * | 9/2005 | Keng et al. | 42/94 |
| 2008/0295379 | A1 * | 12/2008 | Potterfield et al. | 42/94 |
| 2009/0000175 | A1 * | 1/2009 | Potterfield et al. | 42/94 |
| 2009/0038200 | A1 * | 2/2009 | Keng | 42/94 |
| 2009/0064559 | A1 * | 3/2009 | Potterfield et al. | 42/94 |
| 2009/0126250 | A1 * | 5/2009 | Keng | 42/94 |
| 2010/0192449 | A1 * | 8/2010 | Hinds, Jr. | 42/94 |
| 2011/0126444 | A1 * | 6/2011 | Keng et al. | 42/94 |
| 2011/0214330 | A1 * | 9/2011 | Potterfield et al. | 42/94 |
| 2012/0144717 | A1 * | 6/2012 | Peterson et al. | 42/94 |

FOREIGN PATENT DOCUMENTS

WO WO 2007-088002 A1 8/2007

OTHER PUBLICATIONS

International Search Report PCT/US2010/20194, dated Jul. 30, 2010, International Bureau.

* cited by examiner

*Primary Examiner* — Samir Abdosh

(74) *Attorney, Agent, or Firm* — Michael A. Mann; Nexsen Pruet, LLC

(57) ABSTRACT

A bipod device attachable to the Picatinny rail on the underside of the barrel of a military-style gun. The housing of the bipod device includes two parallel channels formed therein to store bipod legs. The housing also includes an external longitudinal groove dimensioned and shaped to receive a Picatinny rail and a locking mechanism to secure the housing to the rail. The housing doubly functions as a grip for the user to support the barrel of the rifle. The two legs can be deployed by pulling them free of their channels in the housing and then pivoting them down and apart in one motion to their deployed position.

11 Claims, 6 Drawing Sheets

BIPOD DEVICE FOR USE WITH PICATINNY RAIL

BACKGROUND OF THE INVENTION

The present invention relates to monopods, bipods, tripods and aiming sticks used in connection with guns.

Marksmanship with a gun, particularly at long range, is improved by using a bipod, tripod or aiming stick. These devices support the barrel end of the gun and eliminate some or most all of the motion of the barrel prior to firing. This motion can come, for example, from the heartbeat or breathing of the marksman holding the gun.

The typical bipod is mounted to the barrel or forestock of the gun and has two positions, a stored position with the two legs folded approximately parallel to the barrel, and a deployed position with the two legs unfolded so that they are approximately perpendicular to barrel and splayed to provide triangular support for gun at the barrel end from the apex of the triangle thus formed. Many bipods have telescoping legs for use by a marksman in the prone, kneeling or standing position.

Bipods work well for the most part but must be rugged so that they do not become bent or broken if the user inadvertently strikes them against a tree or rock while crossing rough terrain. They must also be rust- and corrosion-resistant, and, if part of a military or hunting gun, be capable of taking on non-reflecting or camouflage coatings. Bipods require frequent cleaning so that they are free of dust, dirt and snagged vegetation, particularly in military use. Rust and dirt may make bipods inoperable.

Military-style rifles typically include a Picatinny rail mounted above and often below and to the sides of the barrel on its heat shield as a convenient platform for attaching scopes, grenade launchers, and aiming lasers. A Picatinny rail is a long, thin platform having a flattened hexagonal cross section and a series of uniformly shaped and spaced transverse grooves formed along its length with which to attach various devices to the gun. A military-style rifle may also have a bipod attached to the barrel with legs that fold to the sides of the barrel between the Picatinny rails.

There remains a need for a more convenient, less troublesome bipod, tripod or aiming stick for use with a gun.

SUMMARY OF THE INVENTION

According to its major aspects and briefly recited, the present invention is a bipod device that attaches to a military style firearm having a Picatinny rail. The device includes a housing with channels formed therein that are dimensioned to receive the bipod legs. The device includes an exterior longitudinal groove for attaching it securely to the Picatinny rail below the barrel and also serves as a hand hold for the user to support the barrel.

To deploy the bipod legs, the ends of its legs, that is, their "feet," are grasped and pulled in a direction approximately parallel to the barrel and toward its muzzle to bring the legs out of the channels and to an extended position where they are clear of the channels in the device. Once the bipod legs are completely clear of the channels, the legs may be pivoted directly down and apart into a deployed, splayed position approximately perpendicular to the gun barrel. To store the legs, they are directly pivoted from the deployed position back to the extended position where they are again approximately parallel to the barrel, and may then be pushed back into the channels of the device to the stored position.

The device itself serves both as a protective leg storage container and as a grip configured to fit the hand of a user when supporting the barrel when firing the gun. Because its long dimension, and therefore its channels, is parallel to the major axis of the barrel, it can store bipod legs of sufficient length, including telescoping legs, for good stability for the user firing from various positions. Importantly, it attaches directly and firmly to a Picatinny rail carried by the underside of the barrel at a point comfortable for the user supporting the barrel.

The use of the device to store bipod legs is an important feature of the present invention. Storing the bipod when not in use keeps the bipod legs cleaner, avoids damage to them and having them catch on branches or clothing when hauling the bipod-equipped gun through rough, dense terrain.

These and other features and their advantages will be apparent to those skilled in the art of firearms and firearm bipods from a careful reading of the Detailed Description of Preferred Embodiments accompanied by the following drawings.

DETAILED DESCRIPTION OF THE INVENTION

The present invention is a bipod device that is attachable to the Picatinny rail on the underside of the barrel of a gun.

The term "gun" will refer herein to any firearm having a barrel wherein the barrel may includes a Picatinny rail on its underside. A Pictatinny rail is a long bar that provides a convenient surface for attaching auxiliary devices to firearms. The rail has a flattened hexagonal cross section and a series of transverse grooves along the length of one side of the long bar. The grooves may be evenly-spaced and of constant width.

Many military-style guns include Picatinny rails, such as rifles, pistols and machine guns.

Figure 1:
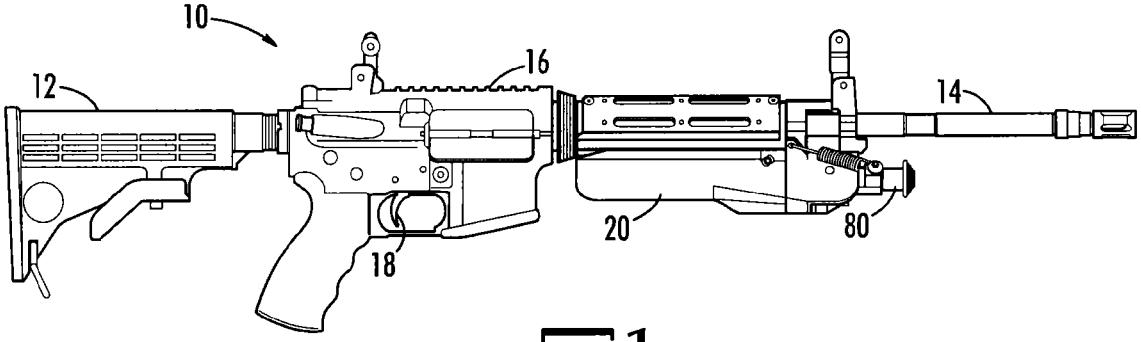
FIG. 1 is a side view of a military style rifle equipped with the present bipod device according to a preferred embodiment of the present invention.
Figure 2:
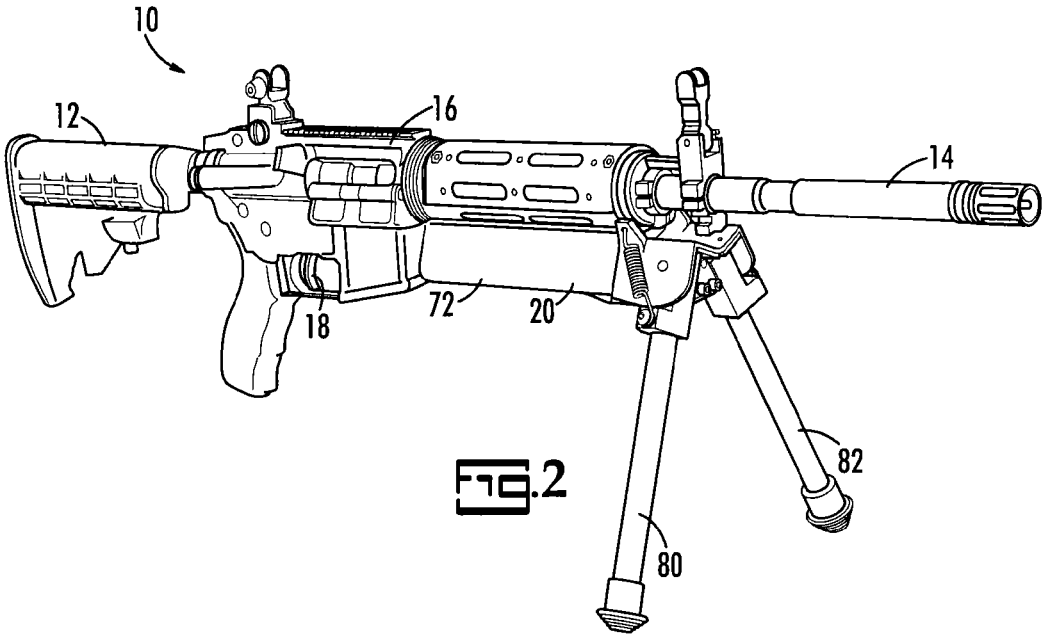
FIG. 2 is a perspective view of the military style rifle of FIG. 1.

Referring now to the FIGS. 1 and 2, there is illustrated a side and a perspective view, respectively, of a gun 10 having a butt stock 12, a barrel 14, a receiver 16, and a fire control mechanism operated by a trigger 18. The operation of these components of gun 10 is conventional, namely, a round of ammunition is loaded into the receiver 16 where it is positioned adjacent to the proximal end of barrel 14, and its primer is then detonated by the fire control system upon pulling the trigger 18. The bullet is thus driven down barrel 14 from its proximal end and out its distal end by the kinetic energy of the exploding gun powder in the cartridge, and on to the target, while the cartridge shell casing is expelled from receiver 16.

In FIG. 1, gun 10 shown from the side with the present bipod device 20 attached to barrel 14 just below a heat shield 22. Bipod device 20 has a housing 72 generally configured to conform to the hand of a user regardless of whether the user is left- or right-handed. Two legs 80, 82 of bipod device 20 are shown in the stored position in FIG. 1. In FIG. 2, gun 10 is shown from a front perspective view with legs 80, 82 in the deployed position.

Figure 3:
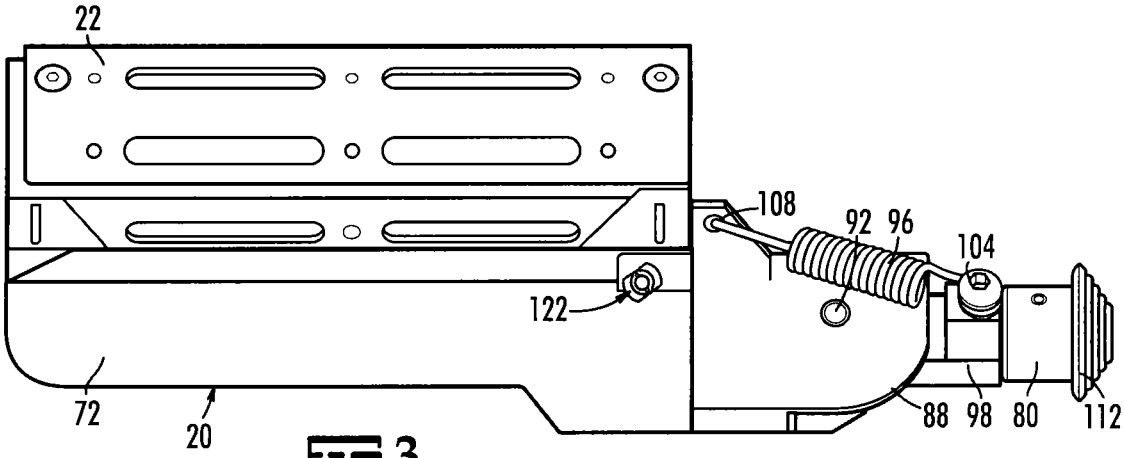
FIG. 3 is a side view of the barrel heat shield and the bipod device with the legs shown in the stored position, according to a preferred embodiment of the present invention.
Figure 4:
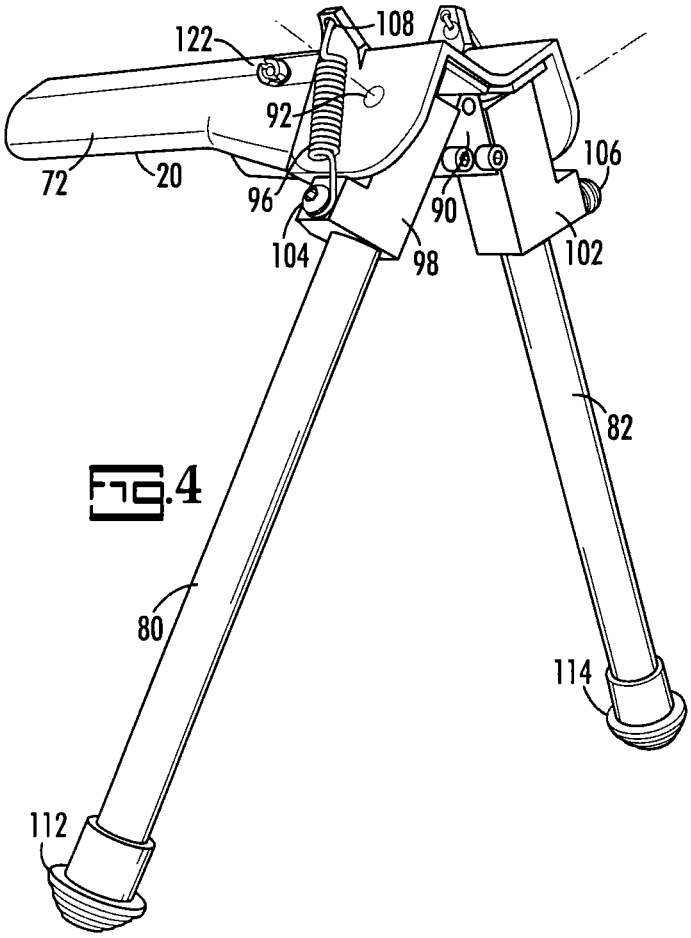
FIG. 4 is a perspective view of the end of a rifle with the bipod device shown with the legs in the deployed position.

FIG. 3 illustrates a right side view of bipod device 20 in relation to heat shield 22. The left-side view is a near-mirror image of the right side of bipod device 20. FIG. 4 shows bipod device 20 from the front perspective with legs 80, 82, in the deployed position. Leg 80 is shown in the stored position with a foot 112 extending therefrom, as seen in FIG. 3. Urging leg 80 into the stored position, as seen in FIG. 3, and into the deployed position, as seen in FIG. 4, are two springs, with FIGS. 3 and 4 both showing a right spring 96 of the two springs, one on the left and one on the right side. Right spring 96 is attached through a hole 108 formed in a stationary bracket 88 and the opposing end of right spring 96 being attached to a bolt 104. Left bolt 106 is visible in FIG. 4. Right and left bolts 104, 106, are attached to pivoting leg brackets 98, 102, respectively. Pivoting leg brackets 98, 102, each have a pivot pin 92 that extends through a hole in stationary bracket 88. A brace 90 is attached to stationary bracket 88 to align legs 80, 82 and enable them to be pivoted directly to a splayed orientation in the deployed position from a parallel orientation in the extended position.

Figure 5A:
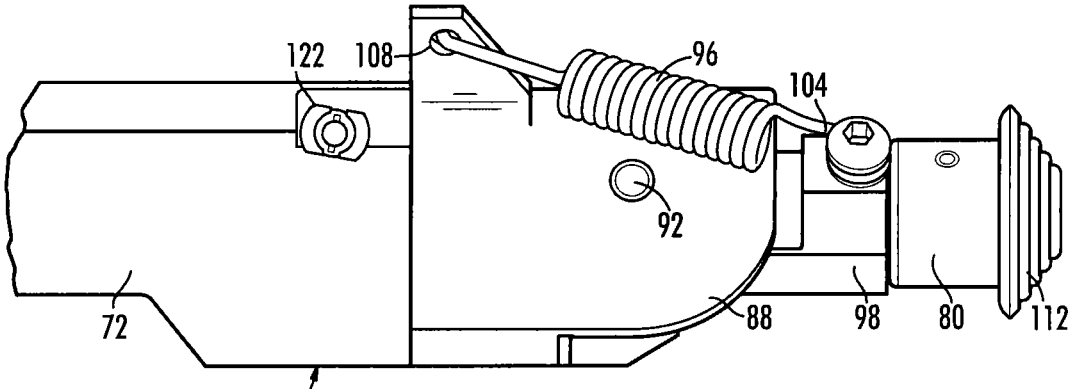
FIG. 5A is a side view of the bipod device with bipod legs in the stored position, according to a preferred embodiment of the present invention.
Figure 5B:
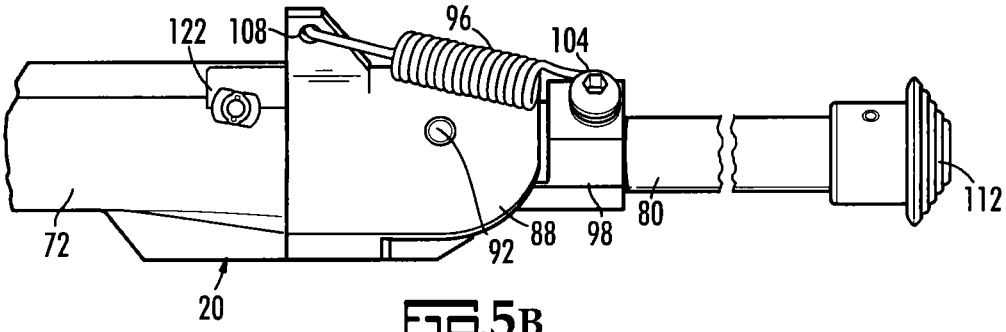
FIG. 5B is a side view of the bipod device with bipod legs in the extended position, according to a preferred embodiment of the present invention.
Figure 5C:
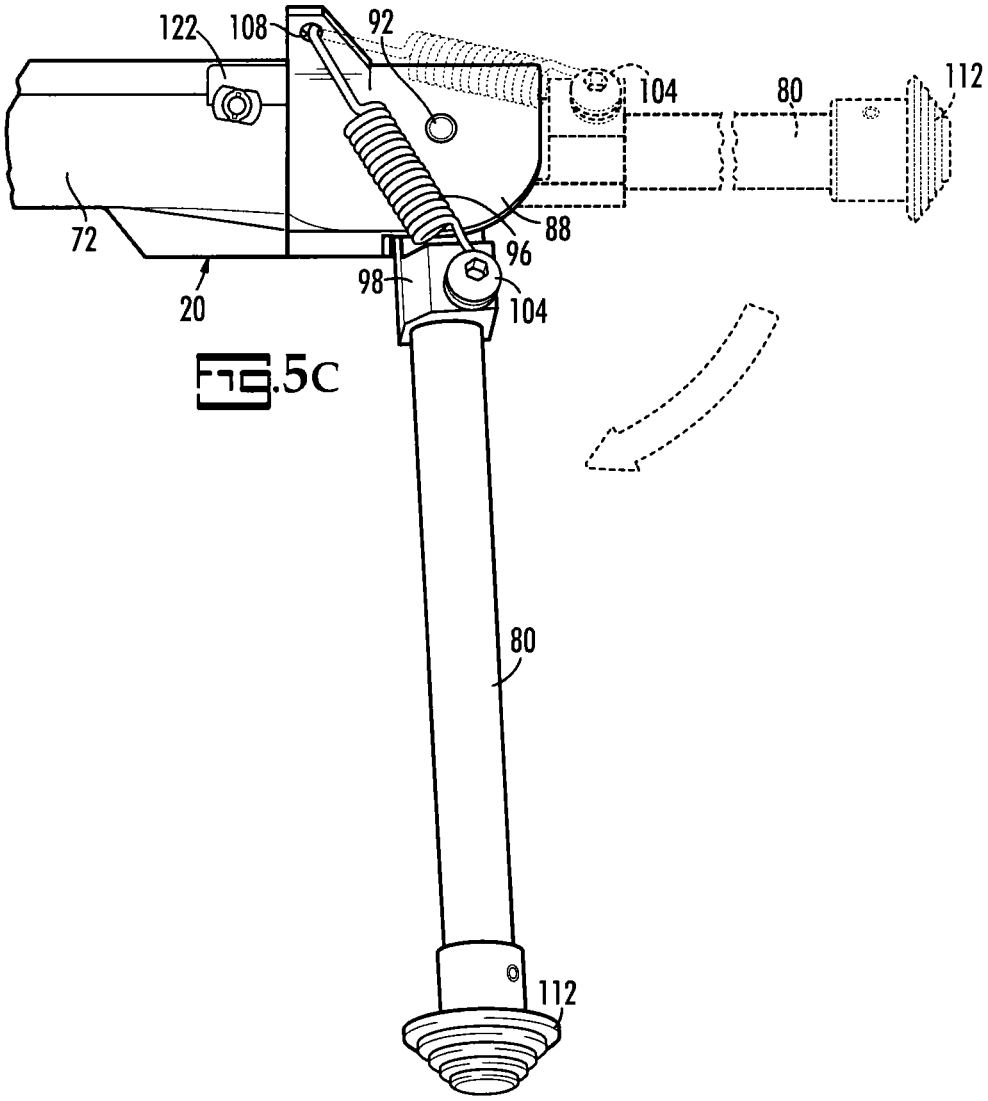
FIG. 5C is a side view of the bipod device with bipod legs in the deployed position, according to a preferred embodiment of the present invention.

FIG. 5A illustrates a detailed, right side view of bipod device 20 in the stored configuration. FIGS. 5B and 5C illustrate the same right side view of bipod device 20 but with first and second legs 80, 82 in the extended and in-use configurations, respectively. The left side of bipod device 20 is a mirror image of the right side.

Bipod device 20 includes stationary bracket 88 mounted to the distal end of bipod device 20 and a brace 90 (see FIG. 4). Bracket 88 and brace 90 hold first and second legs 80, 82 at an appropriate, splayed angle, as shown in FIG. 5C, which may be no more than 90 degrees or somewhat less in the deployed position for providing stable support for barrel 14. When first and second legs 80, 82, are folded to the extended position (FIG. 5B), first leg 80 pivots about first pivot pin 92 and second leg 82 pivots about second pivot pin (not shown). First and second legs 80, 82, are parallel to each other in the extended position. From the extended position, first and second legs 80, 84 can be pushed into the channels formed in housing 72 where they remain in the stored position, as shown in FIG. 5A, until their next use.

Figure 6:
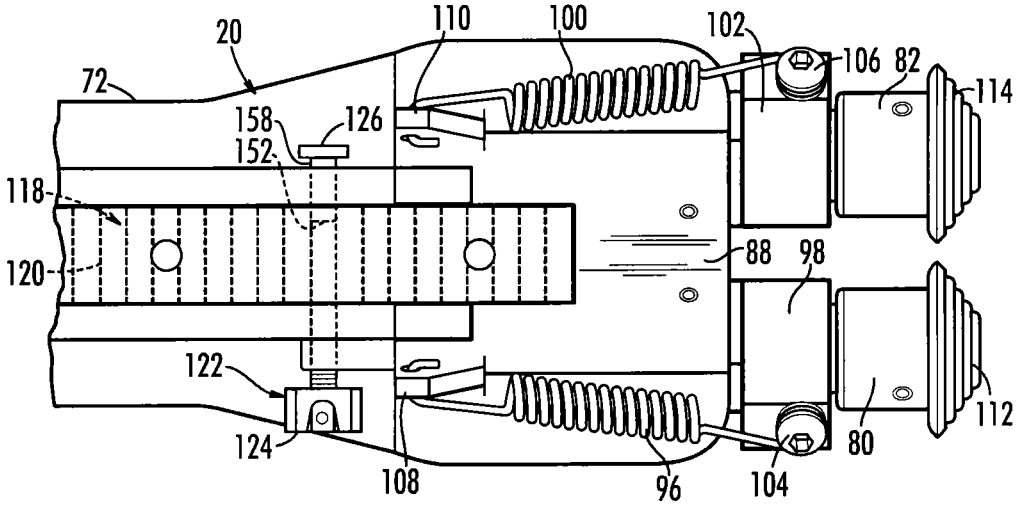
FIG. 6 is a top view of a bipod device, according to a preferred embodiment of the present invention.

As best seen in FIG. 6, which is a top view of bipod device 20, bipod device 20 includes a first spring 96 connected to first leg 80 via a first pivoting bracket 98 and a second spring 100 connected to second leg 82 via a second pivoting bracket 102. First and second springs 96, 100 are extension springs and are extended when first and second legs 80, 82 are moved from the stored position (FIG. 5B) but the forces on springs 96, 100, are relieved when first and second legs 80, 82, are then folded the remainder of the way, to the deployed position (FIG. 5C). First and second springs 96, 100, thus bias legs 80, 82 to the stored and to the deployed positions and away from the intermediate, extended position.

FIG. 6 also shows Picatinny rail 118 and its transverse grooves 120, shown in phantom lines, as well as locking device 122 having a lock nut 124 at one end and a stopper 126 at the opposing end of a rod 158. Device 20 has a longitudinal groove 150 formed parallel to its long dimension that is shaped to receive Picatinny rail 118 (se FIG. 9) and that allows device 20 to be moved parallel to the long dimension of rail 118. Tightening lock nut 124 pushes a tooth 152 (FIGS. 6 and 8) on the opposing end of rod 158 into transverse groove 120 so that device 20 cannot thereafter be moved with respect to rail 118. Loosening lock nut 124 allows locking device 122 to be slid transversely enough to slide that tooth 152 out of transverse groove 120 and thereafter allow bipod device to be moved with respect to Picatinny rail 118.

As also shown in FIG. 6, the top view of bipod device 20, the positions of first and second legs 80, 82, clearly affect the tension on first and second springs 96, 100. As first and second legs 80, 82, are moved axially away from stationary bracket 88, the tension on first and second springs 96, 100, increases and with it the bias toward the stored and deployed positions and the relative difficulty of moving first and second legs 80, 82 from these positions.

First and second legs 80, 82, may telescope, as is well known in bipod legs generally, and may terminate in first and second feet 112, 114, respectively, which also serve as convenient handles for grasping and pulling first and second legs 80, 82 from the larger diameter sections. The opposing ends of first and second springs 96, 100, are attached to bracket 88 by bolts 104, 106.

Figure 7:
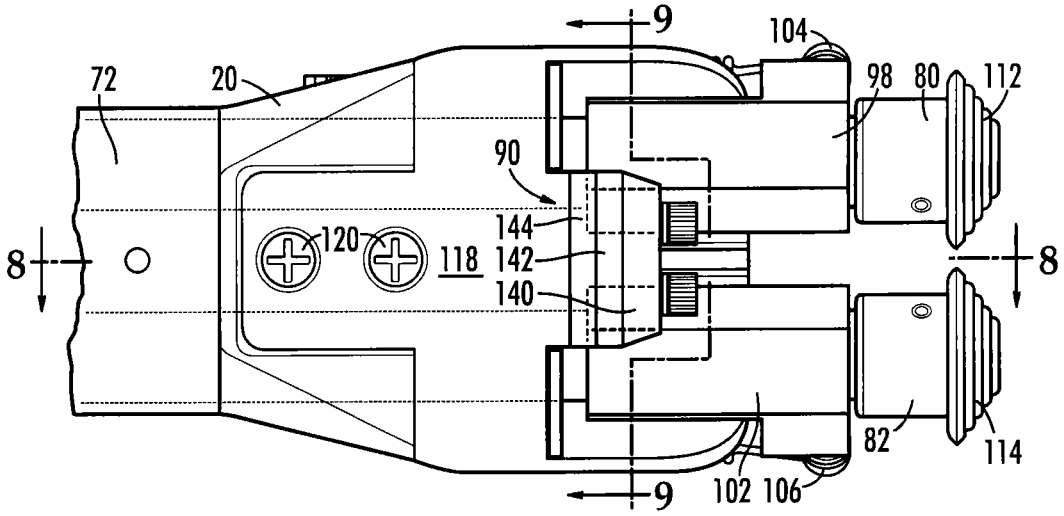
FIG. 7 is a bottom view of the bipod device, according to a preferred embodiment of the present invention.
Figure 8:
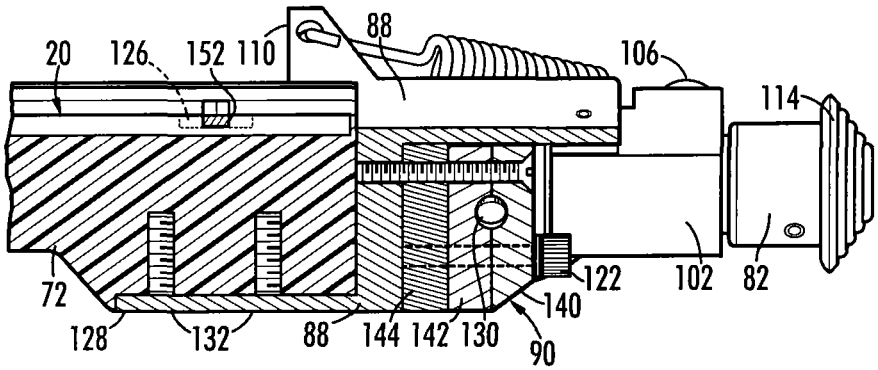
FIG. 8 is a side, cross-sectional view taken along line 8-8 of FIG. 7 of the bipod device with legs in the stored position, according to a preferred embodiment of the present invention.
Figure 9:
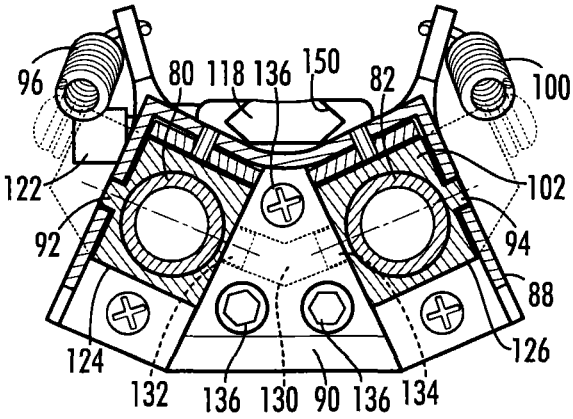
FIG. 9 is an end view of the bipod device taken along line 9-9 of FIG. 7, according to a preferred embodiment of the present invention.

Bracket 88 is secured to housing 72 from underneath where a tang 128 extends rearward (away from the muzzle end and toward the receiver), as best seen in FIG. 7 but also visible in FIG. 8. Two screws 132 hold tang 128 to housing 72. Three more screws 136 hold brace 90 to the end of housing 72 and in turn hold bracket 88 fast to housing 72. Brace 90 assures the alignment of first and second legs 80, 82 as they are pivoted from the extended position to the deployed position and back, the ends of which legs 80, 82, are secured to first and second pivoting brackets 98, 100 by pivot pins 92, 94 and 132, 134 (best seen in FIG. 9) so that pivoting brackets 98, 102 pivot at an angle with respect to each other. Pivoting brackets 98, 102 carry first and second pivot pins 92, 94, respectively (FIG. 9) to maintain the alignment of legs 80, 82 with stationary bracket 88 when legs 80, 82 are pivoted. Brace 90 has an angled hole 130 (or two separate holes) formed in it for receiving first and second pivot pins 132, 134, that correspond to pivot pins 92, 94 in that they are axially aligned with each other; first pin 92 is axially aligned with first pin 132, and second pivot pin 94 is axially aligned with second pivot pin 134. Preferably, first pivot pin 92, first pivot housing 124, and first pivot pin 132 are integrally formed with pivoting brackets 98, 100, as is second pivot pin 94, second pivot housing 126, and second pivot pin 134. Thus brace 90 serves two functions: it helps to position first and second legs 80, 82, in bracket 88 and it serves as a bearing for first and second pivot pins 132, 134.

Brace 90 is conveniently made in two parts, a front part 140 and a rear part 142 to facilitate assembly, as best seen in FIG. 8. In addition, a shim 144 inserted between bracket 88 and rear part 142, may be used to tighten front and rear parts 140, 142 together about first and second pivot pins 132, 134.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention, which is defined by the appended claims.

What is claimed is:

1. A gun, comprising:

(a) a stock;

(b) a receiver carried by said stock;

(c) a barrel attached to said receiver, said barrel having a major axis, said barrel carrying a Picatinny rail, said Picatinny rail having plural transverse grooves;

(d) a fire control system carried by said receiver and operated by a trigger for enabling a user to fire a round of ammunition through said barrel; and (e) a bipod device having a major dimension and being carried by said Picatinny rail of said barrel so that said major dimension of said bipod device is parallel to said major axis of said barrel, said bipod device having (1) a housing with two spaced-apart channels formed therein parallel to said major axis of said barrel, (2) a stationary bracket carried by said housing, (3) a pair of pivoting brackets carried by said stationary bracket, said pivoting brackets being pivotable with respect to said stationary bracket, (4) two legs carried in said channels and slidable with respect to said housing, said stationary bracket and said pivoting brackets between a stored position in said two channels and an extended position outside said channels, said pivoting brackets permitting said two legs to pivot between said extended position and a deployed position approximately perpendicular to said axis of said barrel, said two legs being parallel when in said extended position and being splayed when in said deployed position, wherein said bipod device has a longitudinal groove formed therein dimensioned and shaped to receive said Picatinny rail, and wherein said gun further comprises a lock to secure said Picatinny rail in said longitudinal groove.

2. The gun as recited in claim 1, wherein said lock includes a tooth that is movable into any transverse groove of said plural transverse grooves of said Picatinny rail.

3. The gun as recited in claim 1, wherein each leg of said two legs has a first end and an opposing second end, said first end carrying a ground-engaging foot.

4. The gun as recited in claim 1, further comprising two springs, each spring of said two springs having a first end attached to said stationary bracket and an opposing second end attached to a leg of said two legs, said two springs urging said two legs to said stored and said deployed position from said extended position.

5. A bipod device for use with a Picatinny rail, said rail having a cross sectional shape and plural transverse grooves, said device comprising:

(a) a housing having a first end and an opposing second end, and two parallel channels formed therein, said housing having a major dimension with a longitudinal groove formed therein dimensioned and shaped to receive a Picatinny rail, said channels and said longitudinal groove being parallel to said major dimension;

(b) a stationery bracket carried by said housing;

(c) two pivoting brackets carried by said stationary housing, said pivoting brackets being pivotable with respect to said stationary bracket;

(d) two legs dimensioned to be receivable in said channels and slidable with respect to said stationary bracket and said two pivoting brackets between a stored position and an extended position outside said channels, wherein said two legs are parallel and not in said two channels, and said pivoting brackets permitting said two legs to pivot between said extended position and a deployed position wherein said two legs are splayed and perpendicular to said major dimension of said housing.

6. The bipod as recited in claim 5 further comprising a locking mechanism carried by said housing, said locking mechanism locking said housing to said Picatinny rail.

7. The bipod as recited in claim 5 wherein said Picatinny rail has plural transverse grooves and wherein said bipod further comprises a locking mechanism for locking said housing to any transverse groove of said plural transverse groove.

8. The bipod as recited in claim 5, wherein said housing is configured to conform to a hand of a user.

9. The bipod as recited in claim 5, wherein said two pivoting brackets pivot at an angle with respect to each other.

10. The bipod as recited in claim 5 further comprising springs for urging said first and second legs to said stored and deployed positions from said extended positions.

11. The bipod as recited in claim 6 wherein said springs have first ends attached to said stationary bracket and second ends attached to said first and said second pivoting brackets.

* * * * *